United States Patent [19]

Tari et al.

[11] Patent Number: 4,858,903

[45] Date of Patent: Aug. 22, 1989

[54] HAND SURGERY OPERATING TABLE

[75] Inventors: Gabor Tari; Laszlo Hari, both of Szentes, Hungary

[73] Assignee: Metripond Merleggyar, Hungary

[21] Appl. No.: 786,957

[22] Filed: Oct. 4, 1985

Related U.S. Application Data

[63] Continuation-in-part of Ser. No. 579,296, Feb. 15, 1984, abandoned, which is a continuation-in-part of Ser. No. 308,804, , abandoned.

[30] Foreign Application Priority Data

Nov. 28, 1980 [HU] Hungary ..... 2836/80

[51] Int. Cl.[4] ..... A61G 13/00

[52] U.S. Cl. ..... 269/328

[58] Field of Search ..... 269/328, 45, 74, 72; 128/133, 87 A, 20; 46/1 R; 248/274, 160, 104

[56] References Cited

U.S. PATENT DOCUMENTS

| | | | |
|---|---|---|---|
| 2,022,883 | 12/1935 | Gee | 128/87 A |
| 2,608,192 | 8/1952 | Heitmeyer et al. | 128/20 |
| 2,783,758 | 3/1957 | Trott | 269/328 |
| 3,528,413 | 9/1970 | Aydt | 269/328 |
| 3,529,797 | 9/1970 | Street | 248/160 |
| 3,540,719 | 11/1970 | Romney et al. | 269/328 |
| 3,614,085 | 10/1971 | Cunningham | 269/328 |
| 3,746,332 | 7/1973 | Hakstian | 269/328 |
| 4,082,251 | 4/1978 | Strickland | 269/328 |
| 4,143,652 | 3/1979 | Meier et al. | 128/20 |
| 4,205,533 | 5/1980 | Forester et al. | 269/328 |

FOREIGN PATENT DOCUMENTS

| | | | |
|---|---|---|---|
| 821287 | 8/1969 | Canada | 128/133 |
| 106631 | 11/1963 | Netherlands | 248/160 |
| 983560 | 2/1965 | United Kingdom | 248/160 |

*Primary Examiner*—Robert C. Watson

*Attorney, Agent, or Firm*—Handal & Morofsky

[57] ABSTRACT

A hand surgery operating table connectable to a conventional main operating table and consisting of a forearm support that is rotatable in a horizontal plane as well as pivotable about a horizontal axis, further comprising a base plate carrying a hand support; and up to seven flexible and tensionable arms secured at one end to the base plate and carrying finger-fixing thimbles at the other end. The tension of the arms can be adjusted to any desired extent so that they can either maintain their tensioned fixed position or they can be readily displaced therefrom without having to manipulate their tensioning mechanism.

20 Claims, 4 Drawing Sheets

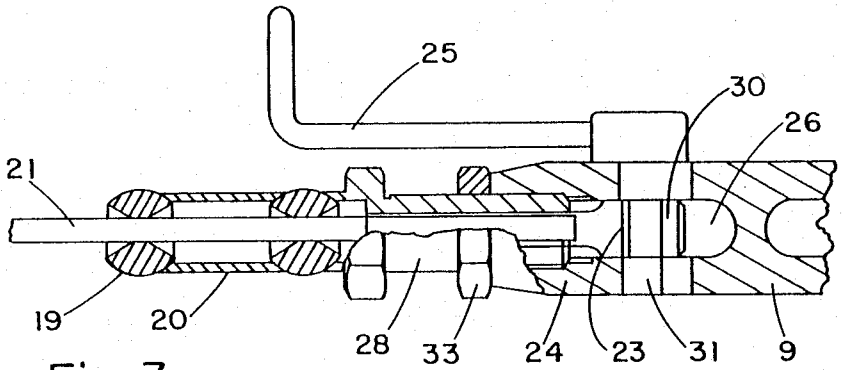
Fig. 3c
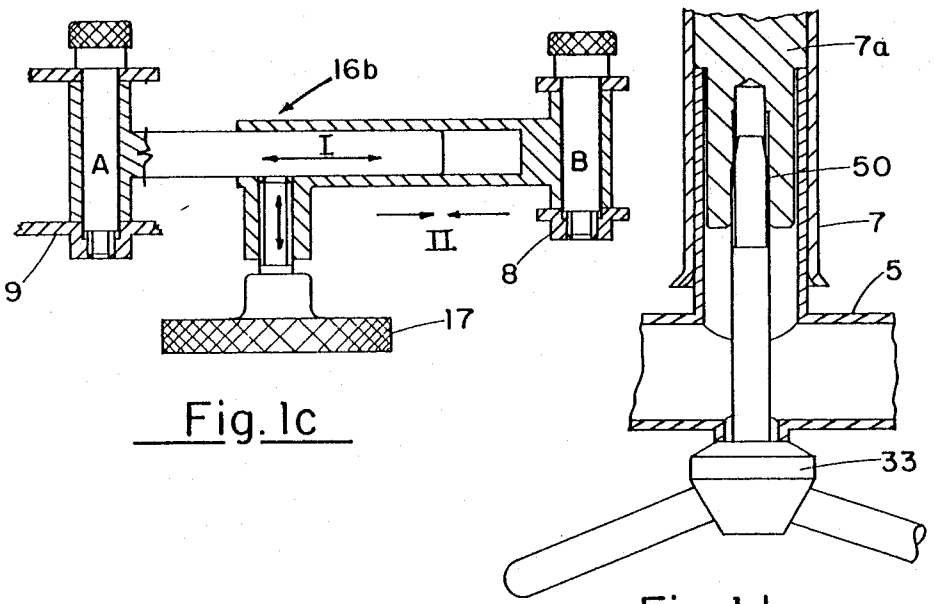
Fig. 1c
Fig. 1d
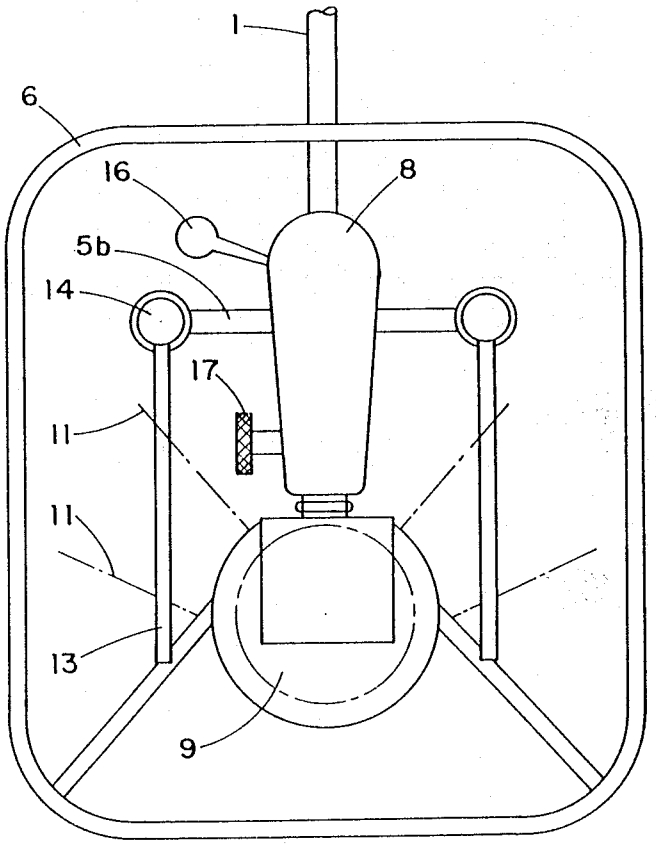
Fig. 2

HAND SURGERY OPERATING TABLE

This is a continuation-in-part of our co-pending application Ser. No. 579,296, filed Feb. 15, 1985, now abandoned which is a continuation application of our Ser. No. 308,804, now abandoned.

FIELD AND BACKGROUND OF THE INVENTION

This invention relates to a hand surgery operating table, for the rapid and quick securing, as well as accurate positioning of a hand for surgery.

It is well-known that in the course of surgery, an operating surgeon performs the more demanding operations with the aid of assistants. This also means that within a relatively small area, the activity of four to six and possibly more hands has to be coordinated. However, the space available for this purpose is relatively small and thus the crowding together of many hands makes the operations more difficult. In addition, in the course of an operation certain instruments or certain tissues or arteries etc. associated with the area to be operated on must be maintained in accurately set positions for a long time and, under the above-described circumstances, this is not realized in practice.

A particularly difficult problem is presented in the course of hand surgery when performed on a so-called hand surgery table. Since a human hand is a collection of very small and complicated structures, the use of magnifiers or even operating microscopes has become ever more widespread for such operations. Accordingly, it is more important than ever that the hand, as the "workpiece" of hand surgery, should be positioned and secured accurately. Yet to this day, hand operations are performed on hand surgery operating tables which, in their essence, do not differ from ordinary operating tables.

Essentially, hand surgery operating tables consist of a quadrangular, planar plate connected to an operating table. The operation on a hand placed on this table is generally performed by the operating surgeon with the aid of assistants. In the case of more serious operations, one assistant attempts to fix the hand in a suitable position, while another assists in the exposure following incision by using retractors. Such operations may often take several hours and they are generally performed in a position non-coplanar with the plane of the hand surgery operating table; the assumption of a fixed position of the hand and of the fingers should be ensured by the assistants, but the required total lack of movement is clearly and manifestly illusory in the above-described circumstances.

In more recent times several attempts have been made for modernizing hand surgery operating tables to overcome the above-described evident contradictions. In simple construction, the hand surgery operating table was of a form pivotable about a predetermined angle and grooves, conforming to the shape of the fingers, were provided in its top surface. The fingers could be fixed in the recesses or grooves by means of rubber rings. In a further-developed variant of this construction, hooks recessed into the surface have been used to secure the fingers.

This method of securing a hand in position is fairly primitive and since operations always take place in three dimensioned, the planar plate fixing the hand cannot assure the required hand positioning, even if it is pivotable.

To solve the tasks of fixing a hand and fingers in position and to achieve satisfactory retraction for exposing the edges of the incision, constructions have also been proposed which consist essentially of a metal sheet shaped in the contour of a hand and having a serrated or toothed edge. Here also the hand and the fingers are fixed with the aid of slits and rubber strips. To open up the edges of the incision, hooks fixed on ball-and-chain units have been employed. The length of the chains can be regulated by hooking in at the serration at the edges of the sheet. In order to allow the clamping to be performed in "space", the construction is provided with chain-raising devices that can also be fixed to the toothed edges of the sheet.

In practice this construction did not afford significantly greater advantages than those described above. The hooking can only be performed slowly and in a cumbersome manner and, in spite of it, the desired positions can only partially be pre-set. Thus, for instance, no retraction is possible in an upward direction. It is not possible to adjust the pivot or to turn the hand.

A so-called lead "hand" has also been used in many places for hand operations. This "hand", made from lead sheet, is an auxiliary device cut into the shape of a hand to which the hand and its fingers can be fixed by means of thread, bandage, rubber rings or, in given cases, by lugs formed in the plate. The adjustment of the position of the hand and fingers takes place by bending the lead sheet about while the limb to be operated on is itself fixed by slings operated by the assistants.

Manifestly this solution does not assure the conditions required for a disturbance-free performance of operations and, in addition, the lead "hands" wear out relatively quickly, i.e. they break to pieces. Generally after performing a few operations such lead "hands" are so bent that they cannot be used any further.

As we have seen, the above-listed auxiliary devices cannot assure the optimum positioning of the limb to be operated on, not even in a static condition. Therefore, it cannot be expected that these constructions should be suitable for adjusting the hand to several different positions, as is often required in certain operations, i.e. to change its position or orientation. The fact that these constructions have not become widespread in practice can be ascribed to the above-mentioned disadvantages and, that is why, in the main, hand operations are still performed on a simple table.

SUMMARY OF THE INVENTION

The present invention has as its objective the provision of an auxiliary device, a hand operating table, which can be coupled to a normal operating table, whereupon it can rapidly and simply fix the limb to be operated on in all its possible positions and rapidly and simply release the limb therefrom and, wherein auxiliary personnel are no longer needed, thus affording more space for the operating surgeon by virtue of providing both clamping and sound exposure or retraction.

The above objective is realized according to the invention by providing an apparatus including a mechanism for supporting the table and elements for supporting the arm and fixing the fingers, wherein the finger-fixing elements are formed as flexible arms each provided at its end with flexible thimbles and/or instrument-supporting elements. The flexible-finger fixing elements may contain alternately arranged sleeves and balls, wherein the external spherical surface of each ball (which is provided with a bore) lies against conical or arcuate inner surfaces provided at the ends of two adjacent sleeves end a wire is threaded through the elements, one end of the wire being fixed to the flexible arm, while the other end is provided with a tensioning device.

Each ball is preferably provided with a passageway which diminishes in cross-section towards the center of the ball, with the smallest diameter of the passageway being at least 1.5 times, but preferably 1.2–1.4 times the external diameter of the wire. The passageways may be formed by bores located between conical sections or they may have a continuously varying cross-section. When bores are employed, their length is at most 0.2 times, but advantageously 0.15 times, the diameter of the balls. The generatrices of the conical sections make an angle of 25°–35°, expediently 30°, with the geometrical axes of the passageways.

Where the passageways have a continuously varying cross-section, the tangents to the mantle surfaces make an angle of 25°–35°, expediently 30°, with the geometrical axes of the passageways at the line of intersection between the spherical mantle surface and the mantle surfaces of the passageways.

The length of the sleeves is preferably no greater than 1.5 times the diameter of the balls. The length of the sleeves is generally uniform and is, preferably identical with the diameter of the balls.

The two ends of each sleeve have an arcuate or conical rounding-off corresponding to the radius of the balls. The flexible arms may be secured to a base plate by means of a fixing mechanism. Appropriately, a spatially adjustable hand-supporting element is connected to the base plate. The hand-supporting element is adjustably secured to a main holder connectable to the operating table.

The tensioning device for the flexible arms is conventionally an eccentric mechanism. The thimbles are exchangeably mounted on connecting stubs with the aid of bores at the end of the flexible arms. Preferably, the thimbles may also be provided with instrument-holding bores. The bores provided for the connecting stubs and the bores for holding instruments may be of the same dimensions and, in general, their geometrical axes may be at a solid angle with each other. The flexible thimbles themselves are preferably formed from a sterilizable plastic material.

A forearm support is adjustably connected to the arm holder of the apparatus by way of, preferably, flexible fixing straps. Additionally, the apparatus may also contain a mechanism for supporting the arm of the operating table.

The hand surgery operating table, according to the invention, accurately fixes the limb to be operated on in any desired position and this position is maintained as desired for as long as necessary. At the same time, the position may be rapidly changed without having to release the tensioning device.

By utilizing the flexible thimbles in the apparatus, securing may be achieved without damage to tissue material and, at the same time, these thimbles are also suitable for holding and adjusting various instruments, e.g. hooks or retractors.

The apparatus enables the reduction of the number of assistants and therefore, the site of the operation is rendered significantly more accessible. In this way, the risk of infection is decreased and, magnifying devices or microscopes may be readily employed in the operations.

A further advantage of the hand surgery operating table according to the invention resides in that with the fixing of the fingers, the cuticles are automatically covered up, thereby significantly reducing the risk of infection.

The apparatus is simple to dismantle and to clean and every one of its components may be sterilized.

BRIEF DESCRIPTION OF THE DRAWINGS

The invention is described, purely by way of example, with reference to the accompanying diagrammatic drawings, wherein:

FIGS. 1*a*–1*d* are partial sectional views showing details of fixing levers in FIG. 1;

FIG. 2 is a plan view of one part of the hand operating table shown in FIG. 1.

FIG. 3*c* is a partial sectional view of the flexible arm showing the coupling thereof to the base plate and its tensioning in assembled form.

DESCRIPTION OF THE PREFERRED EMBODIMENT

Figure 1:
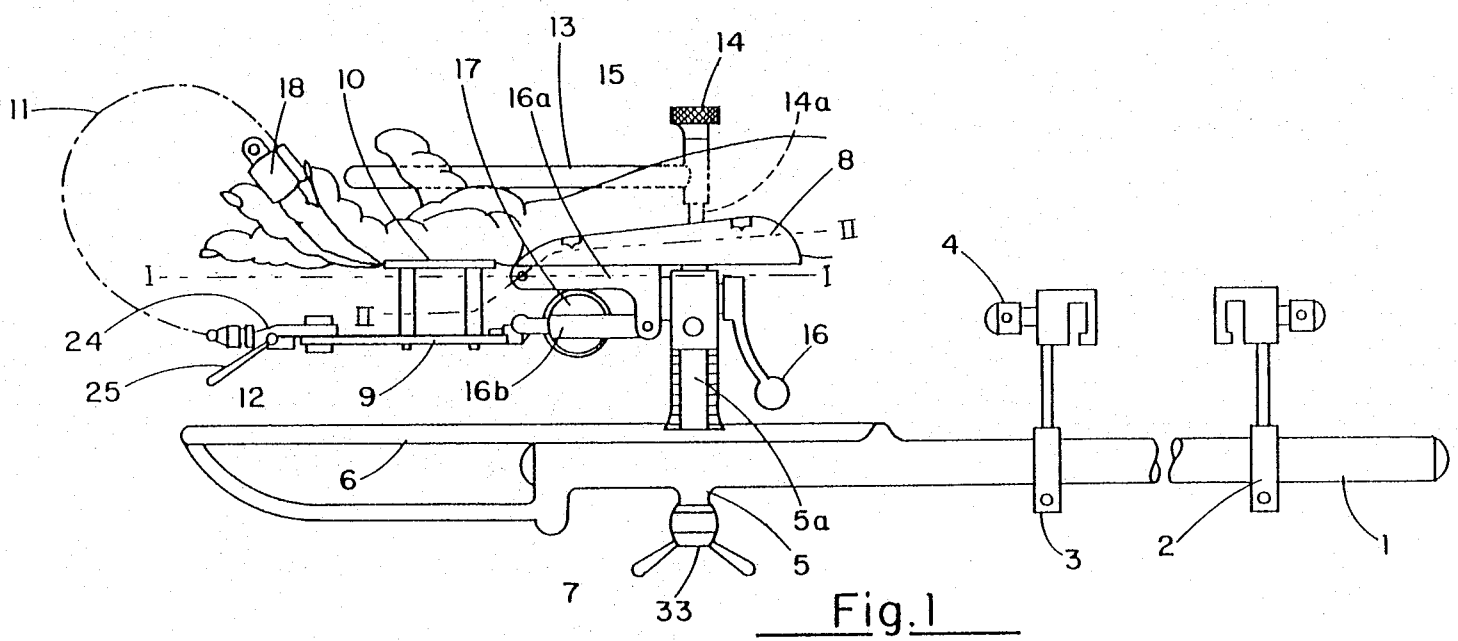
FIG. 1 is a side view of one preferred embodiment of the apparatus according to the invention.

The hand surgery operating table shown in the Figures can be connected to a conventional operating table by means of a main holder 1. This can be done by vises 2 of a standard design, shown at the end of the main holder 1, which vises can be coupled to the rails conventionally provided on the side of the operating table. Their position on the main holder 1 can be fixed by means of screws 3, while their position on the operating table can be fixed by means of fixing elements or clamps 4. Thus the much smaller hand surgery table assumes a piggy-back position with respect to the larger conventional operating table.

The main holder 1 is provided with a connecting sleeve 5 surrounded, for the purposes of isolation, by frame 6.

The hand operating table itself is secured on the main holder 1 by means of a threaded spindle 5*a* extending into the connecting sleeve 5. The threaded spindle 5*a* is surrounded by a protective bell 7 to assure sterile condition in the operating area. A bell insert 7*a* cooperates with threaded spindle 5*a* in fixing the hand surgical table in a predetermined position with handwheel 33 or releasing it and enabling a rotation of the tables about the vertical axis passing through spindle 5*a*.

The hand to be operated on is supported by a support 8 for the forearm. This support is provided with straps made of plastic or rubber to fix the forearm. The hand and palm lie on a hand support 10 fixed on a base plate 9. A plurality of flexible arms 11 are connected to base plate 9 with the aid of fixing mechanisms 12, shown in FIG. 3.

In addition to the above, the apparatus is also provided with various elements suitable for connecting various fittings. Such a fitting, which is coupled to sleeve 5 by a connecting rod 5*b* shown in FIG. 2, may, for example, be an arm support 13 for the surgeon, shown in FIGS. 1, 1*b* and 2 of the drawings, which is securable by a clamping screw 14 to a spindle 14*a* as shown in FIG. 1*b*. Similarly, other auxiliary devices, such as an instrument-holding tray, may be affixed.

Figure 1B:
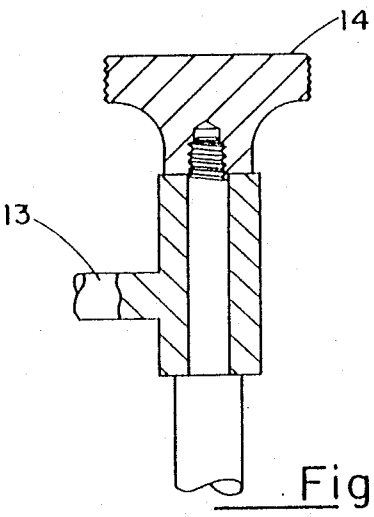
Figure 1A:
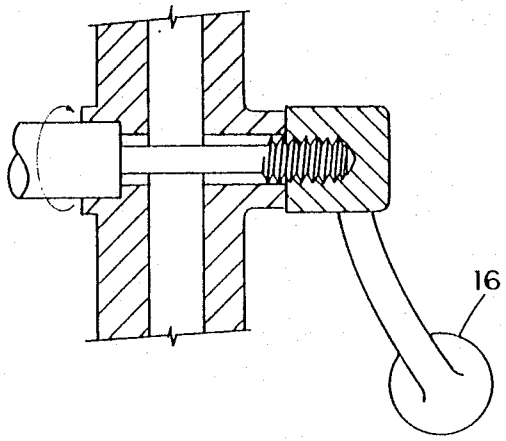

Support 8, supporting the forearm with the hand to be operated on, is angularly displaceable about an axis or shaft 15 and may also be pivoted in a direction perpendicular thereto, as shown in FIGS. 1 and 1*a*. It can be tightened or fixed in a desired position and released with the aid of a fixing lever 16. A hand support 10 connected to the forearm support 8 is also adjustable in any desired direction in space by means of a lever arm mechanism 16*a*, 16*b*. The clamping and releasing of the latter can be affected by a fixing screw 17.

Fixing lever 16 can be any known device which permits the fixing and rotation of an axle. A simple example is shown in FIG. 1*a*, where the turning of lever 16 will adjust the distance between pivots A and B after loosening fixing screw 17. When the distance between pivots A and B is increased, the supports are pivoted about point C and lifted as illustrated by the dotted line I and, when decreased, their position is illustrated by dotted line II.

The most important components of the hand operating table according to the invention are the flexible arms 11 together with their associated fixing mechanisms 12, and thimbles 18 used as finger-fixing elements. These are shown in greater detail in FIG. 3.

Flexible arms 11 are made up of elements which may be angularly displaced relative to each other and which can assure the setting of flexible arm 11 in any desired position. These elements are constituted in the embodiment shown in FIG. 3 by partly-spherical elements (which, for simplicity, will hereafter be referred to as balls 19) and sleeves 20 which are threaded on a wire 21 alternately with the balls 19. At one end of wire 21, there is a connecting link 22, while on its other end there is a pin 23 provided with an eye. The ends of wire 21 are welded or soldered to the bores of these coupling end members 22, 23.

Figure 3:
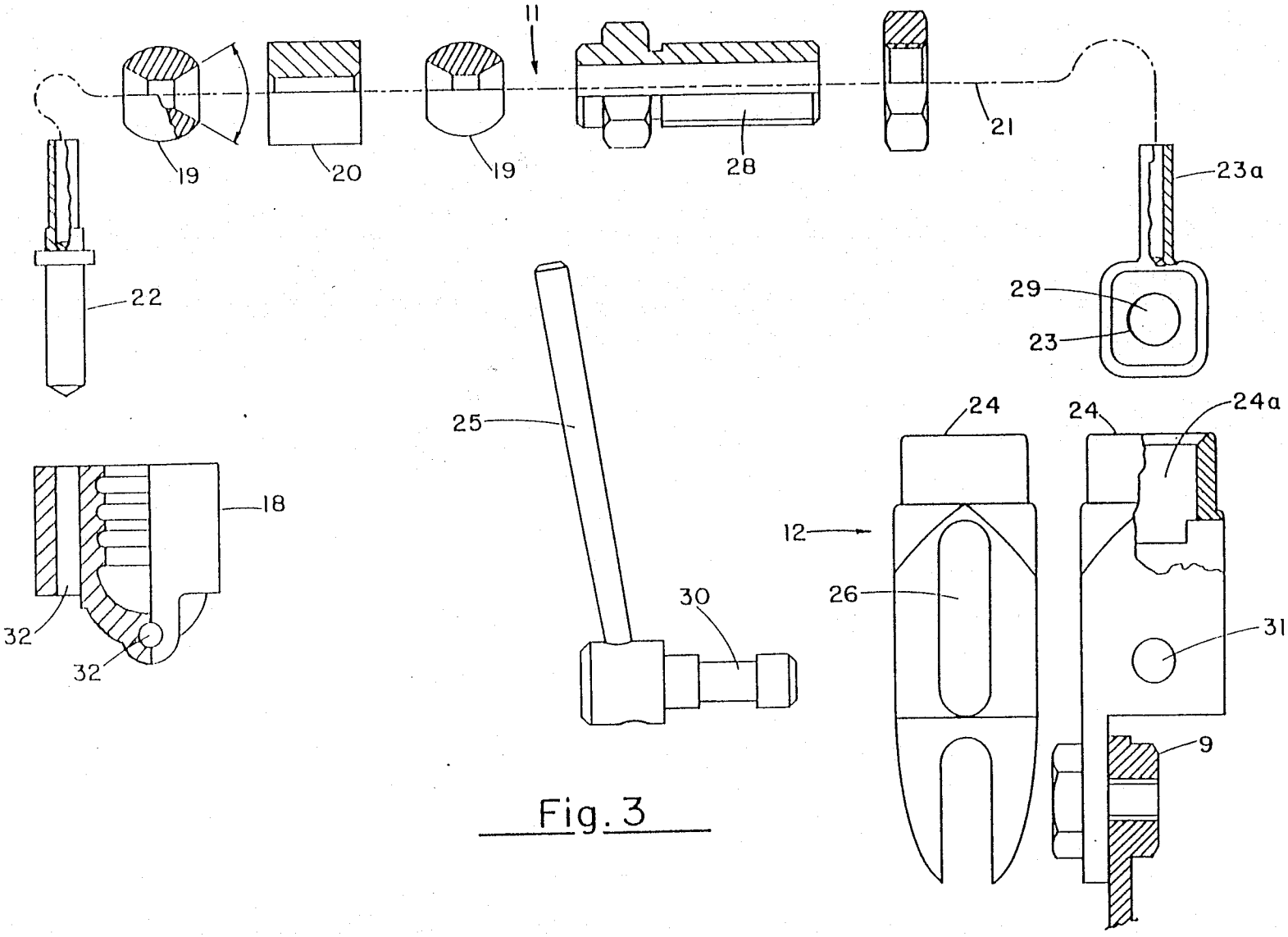
FIG. 3 shows, partially in section, the flexible arm, the tensioning device and the flexible thimbles forming part of the apparatus of FIG. 1.
Figure 3A:
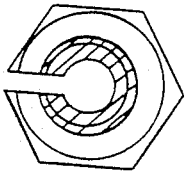
FIG. 3*a* is a side view showing of the split sleeve in FIG. 3.
Figure 3B:
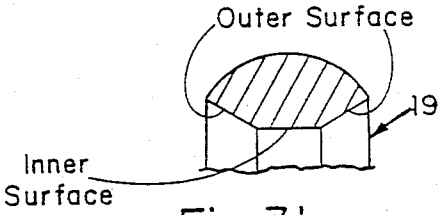
FIG. 3*b* is a broken away view of a ball joint in FIG. 3.

The clamping mechanism 12 for connecting each flexible arm 11 to the base plate 9 and for tensioning wire 21 consists of an eccentric housing 24, shown opened-up in two halves in FIG. 3, and a clamping arm 25. The apertured pin 23 at the end of wire 21 is fitted within the hollow interior 26 of eccentric housing 24 in such a way that its pin portion 23*a* projects, together with wire 21, through a threaded bore 24*a*. A split bushing 28 is threaded into threaded bore 24*a* to guide pin portion 23*a* of apertured pin 23 and to support the first ball 19. Bore 29 of the apertured pin is mounted on an eccentric pin 30 of a fixing arm 25. Eccentric pin 30 is angularly and displaceably journalled in the bores 26 and 31 of eccentric housing 24.

On turning clamping arm 25, eccentric pin 30 moves apertured pin 23 in eccentric housing 24 and its pin 23*a* in split bushing 28 in a forward or rearward direction by its movement in bores 26 and 31 and thus tensions or slackens wire 21. The frictional conditions ensure that clamping arm 25 remains at all times in the set tensioned position without further fixing.

Since the tension of wire 21 is steplessly adjustable with the aid of fixing mechanism 12, flexible arm 11 may be of any desired rigidity. By strongly tensioning wire 21 through clamping arm 25, flexible arm 11 becomes fully rigid and maintains the position it has taken up for any desired length of time. If clamping arm 25 is fully released by being turned in the opposite, or release, direction, then flexible arm 11 is fully slackened and may be bent almost like a wire. The construction according to the invention also enables the setting of an intermediate position wherein to set flexible arm 11 into a new position, it is not necessary to release clamping arm 25 because, with a relatively small force, the position of flexible arm 11 may be changed. This is particularly avantageous in the course of operations where it is often necessary to temporarily, but rapidly, change the position of the fingers.

Balls 19 as well as the sleeves 20 are respectively provided with a center bore in order to enable them to be threaded on wire 21. In addition, the bores of sleeves 20 are provided with a rounded-off part on two sides to match the external surface of the balls 19. This may simply be a conical section or a spherical surface matching the diameter of the balls. However, a combination of these two types of surfaces may also be provided.

The balls are each provided with a passageway, the cross-section of which diminishes from the two sides, so that on bending the appropriate position of the wire 21 can be assured. The passageway of diminishing cross-section from two sides may be constituted by the central bore located between two conical sections as shown in the drawing, but also be for example, a continuously varying cross-section.

To ensure that the appropriate position of wire 21 should be achievable in all positions of the flexible arm 11, the smallest diameter of the passages in the balls is not more than 1.5 times than the outer diameter of the wire. Generally it is advantageous to keep this at a value of between 1.2–1.4 times the diameter of the wire.

In the embodiment shown in FIG. 3, the length of the central bore is 0.15 times the diameter of the balls. To ensure the flexibility of the flexible arm 11, the length of the bore does not generally exceed 0.2 times the diameter of the balls. The generatrices of the conical sections make an angle of 30° with a geometrical axes of the bores or passages, i.e. their full cone angle is 60°. Generally the full cone angle of the conical sections may be between 50°–70°, i.e. the generatrices of the conical sections may include an angle of 25°–35° with the geometrical axes of the passages.

However, the balls may also be formed with passages of continuously varying cross-section. In this case, the above-mentioned angle values must be related to the tangents taken at the line of intersection between the mantle surface of the passage and the outer mantle surface of the balls.

In the illustrated embodiment, the sleeves are all the same kind and their length is the same as the diameter of balls 19. Generally, the length of the sleeves should not exceed 1.5 times the diameter of the balls. However, the sleeves may also be formed with different lengths, advantageously in such a manner that they are shorter at the ends of the flexible arm, while they are longer at its middle. Even in this case in length of the longest sleeve should not exceed twice the diameter of the balls.

Naturally the construction shown in FIG. 3 is not the only possible embodiment for realizing the flexible arm. Thus elements different from those show may also be threaded on wire 21, for example unitary segments formed by a combination of balls and sleeves. Additionally, one could conceive flexible arms formed in the manner of an endoscope fixed between the clamping mechanism and the thimbles.

To fix the fingers of the hand the sleeves or thimbles 18 shown in FIG. 3 may be provided. They are made from a resilient material, desirably from a sterilizable plastics material.

Appropriately there are many different sizes of thimbles 18 in order to enable a selection to be made to match to different finger sizes. The thimbles are connected by way of bores 32 to connecting links 22. Conveniently, several bores 32 are formed on the thimbles and their spatial position varies in order to facilitate desired positions.

The bores not only serve for the connection of the flexible arm 11, but are also suitable for fixing various instruments, e.g. retractors, forceps, etc. To this end, a portion of the bores 32 may be formed with a cross-section differing from the circular. When performing an operation with a hand surgery operating table according to the invention, the main holder 1 is first passed below the plane of the conventional operating table and is fixed by means of screws 3 and fixing elements 4 in a position appropriate to the length of the arm to be operated on. The frame 6 is covered by a sterile cloth and threaded spindle 5*a* of the sterilized hand operating table is fixed into connecting sleeve 5 and fixed in position by a hand-wheel 33. The sterility of the connection is assured by protective bell 7. The forearm of the hand to be operated on is placed on forearm support 8 and fixed with straps. Thimbles 18 of suitable size are then threaded on the fingers of the hand lying on hand support 10 and the hand is placed in the desired position by means of the flexible arms the tensions of which is adjusted by means of fixing arms 25 one being associated with each flexible arm. When the fixing arms are maintained in an intermediate position, then in the course of the operational at any time a single movement allows the position of thimbles 18 and thus of the hand to be changed. Since the hand operating table according to the invention is provided with more than five, in the present embodiment seven, flexible arms 11, further arms are available after fixing the fingers, depending on the operating position, for retractors or instruments.

Arm support 13 forming part of the apparatus enables the operating surgeon to take up the most suitable position and to have his arms well-supported which assures finer work for the operating hand and thus leads to better surgical results, since the range of movement of the joints and sinew of the human hand can work at its finest in the center position of its range.

From the above, it may seem that the hand surgery operating table according to the invention assures a reliable and randomly changeable securing means, without further assistance, in any desired position of the hand to be operated on. In this way the operating area has greatly improved accessibility and, proportionately, the risk of infection during an operation is decreased. The accurate and reliable securing makes operations employing magnifiers or microscopes more efficient. The hand surgery operating table according to the invention meets medical standards in all respects and its use may be quickly and easily learned.

While there has been shown what is considered to be a preferred embodiment of the present invention, modifications may occur to those having skills in the art. It is intended to cover in the appended claims all such modifications which fall within the true spirit and scope of the claims.

What we claim is:

1. An adjustable hand surgery table for immobilizing a hand to be operated upon into a desired position, comprising forearm support connected to a hand support, means for coupling said forearm and hand supports and enabling respective axial and angular adjustment therebetween; a plurality of flexible arms for adjustably securing the fingers in a predetermined space during operation, a base plate, means for coupling each of said plurality of flexible arms to said base plate, a thimble fixed at the end of each of said flexible arms for securely coupling the fingers when placed on the respective fingers to said flexible arms during operation, wherein each flexible arm consists of alternately arranged sleeve joint means and ball joint means, wherein said ball joint means and said sleeve joint means are provided with a bore, a wire being passed through said bore in said sleeve joint means and said ball joint means, one end of said wire is fixed in the flexible arm proximate said thimble means, while the other end is secured to said coupling means, and said ball joint means comprising external spherical surfaces for engaging internally conical surfaces formed at the end portions of adjacent sleeve joint means when assembled for enabling relative sliding movement between said spherical and conical surfaces in the untensioned state of said flexible arm, means operatively connected to said coupling means for selectively adjusting and securing in the adjusted position said coupling means, wherein the adjusting and securing means comprises a tensioning device for the flexible arms.

2. An operating table as claimed in claim 1, wherein the smallest diameter of the ball joint means bore is at most 1.2 to 1.4 times the diameter wire.

3. An operating table as claimed in claim 1, wherein the ball joint means bore comprises a passageway between conical section passages.

4. An operating as claimed in claim 3, wherein the length of the passageway is at most 0.2 times the diameter of the ball joint means.

5. An operating table as claimed in claim 3, wherein the length of the passageway is at most 0.15 times the diameter of the ball joint means.

6. An operating table as claimed in claim 3, wherein the generatrices of the conical section passages make an angle of between 25°–35° with the geometrical axis of the passageway.

7. An operating table as claimed in claim 3, wherein the generatrices of the conical sections makes an angle of 30° with the geometrical axis of the passageway.

8. An operating table as claimed in claim 2, wherein the cross-section of each bore varies continuously.

9. An operating tables as claimed in claim 8, wherein the tangents to the outer mantle surfaces of the bore make an angle between 25°–35° with the geometrical axis of the bore at the line of intersection of the spherical surface and the outer mantle surface of the bore.

10. An operating table as claimed in claim 9, wherein the tangents to the outer mantle surfaces of the bore make an angle of 30° with geometrical axis of the bore at the line of intersection of the spherical surface and the outer mantle surface of the bore.

11. An operating table as claimed in claim 1, wherein the length of the sleeve joint means is uniform and is at most 1.5 times the diameter of the ball joint means.

12. An operating table as claimed in claim 11, wherein the sleeve joint means have a length equal to the diameter of the ball joint means.

13. An operating table as claimed in claim 1, wherein each of the flexible arms is secured to said base plate.

14. An operating table as claimed in claim 1, wherein said adjustable forearm support comprises flexible straps for securing the forearm to said support.

15. An operating table as claimed in claim 1, wherein each thimble comprises a bore for exchangeably connecting said thimble to connecting links provided at the ends of the flexible arms.

16. An operating table as claimed in claim 15, wherein each thimble is provided with additional connecting and instrument-holding bores.

17. An operating table as claimed in claim 15, wherein the geometrical axes of the connecting bore and the additional bores are at a spatial angle to each other.

18. An operating table for hand surgery as claimed in claim 1, wherein said tensioning device comprises an eccentric pin means and an operating arm, said means for coupling said flexible arms to said base plate comprises a housing having a hollow eccentric space therein for receiving said eccentric pin means therein, said operating arm when rotated adjusting the position of said eccentric pin means and thereby tensioning said wire fixedly coupled to said housing.

19. An operating table for hand surgery as claimed in claim 1, wherein said coupling means for said forearm and hand support includes lever means for permitting selective pivoting of said hand and forearm support and means for securing said coupling means in a selected pivoted position.

20. An operating table for hand surgery as claimed in claim 1, including means for selectively adjusting the vertical position of said hand and arm support and means for clamping said adjusting means in a vertical position of said hand and arm support.

* * * * *